United States Patent [19]

Charles

[11] Patent Number: 5,062,197

[45] Date of Patent: Nov. 5, 1991

[54] DUAL-PERMEABILITY CORE STRUCTURE FOR USE IN HIGH-FREQUENCY MAGNETIC COMPONENTS

[75] Inventor: Richard J. Charles, Schenectady, N.Y.

[73] Assignee: General Electric Company, Schenectady, N.Y.

[21] Appl. No.: 519,997

[22] Filed: May 7, 1990

Related U.S. Application Data

[62] Division of Ser. No. 290,078, Dec. 27, 1988, Pat. No. 4,943,793.

[51] Int. Cl.[5] ..... H01F 41/02

[52] U.S. Cl. ..... 29/606; 29/607; 29/608; 336/83; 336/233

[58] Field of Search ..... 29/606, 607, 608, 602.1; 336/83, 233

[56] References Cited

U.S. PATENT DOCUMENTS 4,007,541 2/1977 Monforte et al. ..... 29/602.1 X 4,138,783 2/1979 Portier ..... 29/606

*Primary Examiner*—Carl E. Hall

*Attorney, Agent, or Firm*—Jill M. Breedlove; James C. Davis, Jr.; Marvin Snyder

[57] ABSTRACT

A dual-permeability magnetic core structure is provided for use in small, high-frequency inductors and transformers. The dual-permeability core encloses a winding window containing planar windings and comprises high-permeability and low-permeability sections positioned to produce a highly uniform, or uniformly varying, magnetic field on the winding surfaces. The dual-permeability core products low winding losses and a low AC-to-DC resistance ratio. Fabrication of the dual-permeability core involves a method of controlling the permeability of a magnetic material and a methd of combining structures of two different permeability values.

20 Claims, 5 Drawing Sheets

DUAL-PERMEABILITY CORE STRUCTURE FOR USE IN HIGH-FREQUENCY MAGNETIC COMPONENTS

This invention was made with Government support under contract N66001-87-C-0378 awarded by the Department of the Navy. The Government has certain rights in this invention.

This application is a division of application Ser. No. 290,078 filed Dec. 27, 1988, now U.S. Pat. No. 4,943,793.

FIELD OF THE INVENTION

The present invention relates generally to magnetic core structures for use in small, low-loss, high-frequency inductors and transformers. More particularly, this invention relates to a dual-permeability magnetic core which, in combination with a planar winding, produces low winding losses.

BACKGROUND OF THE INVENTION

It is well-known that the size of magnetic components can be decreased by increasing the operating frequency. However, as frequency is increased, winding losses increase due the presence of eddy currents in the conductors. These eddy currents are caused by AC effects which are magnified at high frequencies, such as skin and proximity effects and fringing fields from air gaps.

Conventional windings at low frequencies are generally solenoidal or helical and are made from circular, square, or foil conductors. At high frequencies, however, the AC-to-DC resistance ratio of such conductors increases markedly due to skin and proximity effects. Thus, for effective utilization of a conductor cross-section, it is advantageous to constrain one dimension of the conductor to one or two skin depths. Consequently, and in contrast to the low frequency case, planar windings are often employed which assist in minimizing the overall volume of an electrical component designed to carry a specified current at high frequencies. Disadvantageously, in order to carry high current or to exhibit a low resistance characteristic, the other cross-sectional dimension of the planar winding cannot be so constrained. Therefore, although conductor volume efficiency is improved by using planar windings, eddy currents and their attendant losses still persist, and the reduction of such eddy currents is of high concern.

Conventional magnetic structures, such as inductors, have high-permeability cores with lumped air gaps. A conventional core also has a winding window for containing conductors encased by an insulating material. The air gaps in a core of sufficiently small volume are so large relative to the overall window size that the fringing field flux penetrates the conductors. Such field non-uniformity generates excessive eddy current losses. As a result, the AC resistance is significantly larger than the DC resistance.

With reference to FIG. 1, a conventional inductor is shown. A high-permeability core 12 having lumped air gaps 10 includes a winding window 14. The winding window contains planar conductors 16*a*, 16*b*, 16*c*, 16*d* and 16*e* encased by an insulating material 18. Referring now to FIG. 2, a graph illustrates the magnetic field intensity tangential to the surfaces of the planar conductors of FIG. 1 as a function of the distance from either side of the core. One of ordinary skill in the art will appreciate that such field non-uniformity generates excessive eddy current losses.

It has been proposed that one way to reduce the AC winding losses, without increasing the size of the winding window, is to distribute the air gaps uniformly around the magnetic core as discussed in "Effects of Air Gaps on Winding Loss in High-Frequency Planar Magnetics" by Khai D.T. Ngo and M.H. Kuo, Power Electronics Specialists Conference Proceedings, April 11–14, 1988, pp. 1112–1119, which is incorporated herein by reference. This distributed gap effect could be realized by constructing the inductor with a magnetic core of ferrite having a low, controllable permeability. The low-permeability core forms a closed-loop structure surrounding the winding window which contains planar copper conductors encased by an insulating material. Although the core structure of low-permeability would reduce the AC winding losses, these losses would still be too high because of the uneven distribution of current in the conductors resulting from field non-uniformity. Specifically, regions of high field intensity result from the crowding of flux lines around corners of the core structure as they follow the paths of least reluctance. This high field intensity causes significant eddy current circulation in the outermost conductors of the winding.

A distributed gap inductor having the characteristics hereinabove described is illustrated in FIG. 3. Low-permeability core 20 includes winding window 22 which contains planar copper conductors 24*a*, 24*b*, 24*c*, 24*d* and 24*e* encased by insulating material 26.

Another approach to loss reduction, also discussed in "Effects of Air Gaps on Winding Loss in High-Frequency Planar Magnetics", cited above, is to employ a multi-layer winding in a distributed gap inductor. Use of a multi-layer winding not only improves the aspect ratio of the core geometry, but also results in reduced core losses. Further, an inductor having a multi-layer winding of the same current and frequency rating requires a larger winding window than its single-layer counterpart, the use thereof thus alleviating the adverse effects of field non-uniformity. Unfortunately, despite the above enumerated advantages, the stacking of conductors to form a multi-layer winding causes higher proximity effect losses. The overall result, however, is an inductor having a comparable or a slightly lower AC-to-DC resistance ratio than the single-layer distributed gap inductor.

Although the above-described recent proposals for magnetic core structures result in lower winding losses, these losses and, thus, the AC-to-DC resistance ratios, are still too high for practical purposes. That is, while AC-to-DC resistance ratios greater than five have been achieved, a ratio closer to unity is desirable. The present inventors, therefore, propose the use of a dual-permeability magnetic core structure comprising alternating sections of high- and low-permeability materials. In a rectangular coordinate system, for example a rectangular or "sleeve" core, an optimized configuration of a dual-permeability core structure would result in a highly uniform magnetic field profile about the planar conductor surfaces. As the term is used herein, a sleeve core is defined as a hollow structure of rectangular cross-section. Further, in a cylindrical coordinate system, for example a cylindrical "pot core", an optimized dual-permeability core structure would result in a magnetic field tangential to the planar winding surfaces which varies inversely with its radius. A pot core is defined herein as a hollow, cylindrical structure having an interior concentric core post. In developing dual-permeability core structures, the present inventors have overcome problems of configuration, optimization, and fabrication of magnetic materials of variable permeability.

OBJECTS OF THE INVENTION

It is, therefore, an object of the present invention to provide a dual-permeability magnetic core for use in low-loss, high-frequency inductors and transformers which carries a highly uniform, or uniformly varying, magnetic field in order to significantly reduce the AC winding losses.

Another object of the present invention is to provide a magnetic core for use in high-efficiency inductors and transformers which is smaller than conventional magnetic cores of similar electrical and magnetic capabilities, but which maintains a highly uniform, or uniformly varying, magnetic field on planar winding surfaces in order to realize a low ratio of AC resistance to DC resistance.

Still another object of this invention is to provide a method of fabricating a dual-permeability magnetic core for use in low-loss, high-frequency inductors and transformers.

SUMMARY OF THE INVENTION

These and other objects have been achieved in a new closed-loop magnetic core comprising sections of high-permeability magnetic material and sections of low-permeability magnetic material distributed to produce a highly uniform, or uniformly varying, magnetic field on planar winding surfaces, thereby resulting in lower AC winding losses. According to the present invention, the lumped air gaps of conventional magnetic cores are replaced by sections of low-permeability magnetic material. The highly uniform, or uniformly varying, magnetic field is achieved by orienting the low-permeability magnetic sections to carry flux flowing parallel to the planar conductor surfaces; in contrast, the high-permeability magnetic sections are oriented to carry flux flowing perpendicular to the conductor surfaces. As a result, the new magnetic core structure has a low AC-to-DC resistance ratio, thus enabling the practical realization of small, low-loss, high-frequency inductors and transformers.

One embodiment of the present invention employs a sleeve core of rectangular cross-section having a rectangular winding window formed therein for containing either a single-layer or a multi-layer winding comprised of planar conductors. The sides of the sleeve core comprise the high-permeability sections, while the low-permeability sections comprise the top and bottom thereof. In this way, a highly uniform magnetic field is obtained. Further, by making the sides of the core C-shaped with the ends thereof contacting the ends of the low-permeability sections and coinciding with imaginary vertical lines drawn through the ends of the planar winding, still greater field uniformity is obtained.

The preferred embodiment of the dual-permeability magnetic core utilizes a pot core structure having an essentially cylindrical shape, the cylindrical peripheral wall comprising a high-permeability material. Within the interior of the core, there is an essentially toroidal winding window enclosed by top and bottom layers or rings comprising a low-permeability material. Extending through the core between the low-permeability layers is a high-permeability core post which is concentric with the peripheral wall of the core. For structures employing multiple turns per winding layer, the inner and outer radii of each turn are selected such that all turns have the same resistance. In this way, the current density distribution also varies inversely with the radius. This matching of current density distribution to magnetic field distribution results in low AC winding losses.

Fabrication of a dual-permeability core requires both a method of controlling the permeability of a magnetic material and a method for combining structures of two different permeability values. Specifically, to fabricate the preferred pot core according to the present invention, the initial step in the process is to machine a core post and a cylindrical peripheral wall of high-permeability magnetic material. A temporary base comprising either a high-permeability material or a low-permeability material is provided to rigidly position the core post with respect to the core wall during assembly. The result is a cup-like core structure. In the preferred embodiment, the high-permeability material comprises a ferrite, and the low-permeability material comprises a mixture of a high-permeability ferrite and an organic binder. A first layer or section of low-permeability material is applied to the temporary base by preparing a ferrite powder and then either: (1) packing the powder into the core at a specified volume fraction, infiltrating the packed powder with an organic binder, and then allowing the resulting mixture to solidify in place; or (2) preparing and casting a specified volume fraction mixture of the powder and an organic binder directly on the base and then allowing the mixture to solidify in place; or (3) preparing a mixture of the powder and an elastically deformable organic binder and forming a ring-shaped compact thereof to conform to the internal dimensions of the core and then press fitting the low-permeability compact as a layer within the core, thus compressing the compact in order to develop close tolerance fit of the layer compact to the core post and core wall; or (4) machining a rigid low-permeability material, which comprises either a mixture of the ferrite powder and an organic binder or a sintered ferrite material, to form a ring-shaped compact which conforms to the internal dimensions of the core, inserting the compact into the core by sliding fit, and then filling any gaps between the high- and low-permeability sections with a second castable mixture of a fine magnetic powder and an organic binder.

Above the first layer of low-permeability ferrite, a planar winding or interleaved planar windings are inserted into the core. After damming the winding leads, a second layer of low-permeability ferrite is applied above the winding according to one of the four above-enumerated alternative processes. Finally, the temporary base is removed by machining or other separation methods, and the entire core is machined to the required size.

The features and advantages of the present invention will become apparent from the following detailed description of the invention when read with the accompanying drawings.

DETAILED DESCRIPTION OF THE INVENTION

Figure 1:
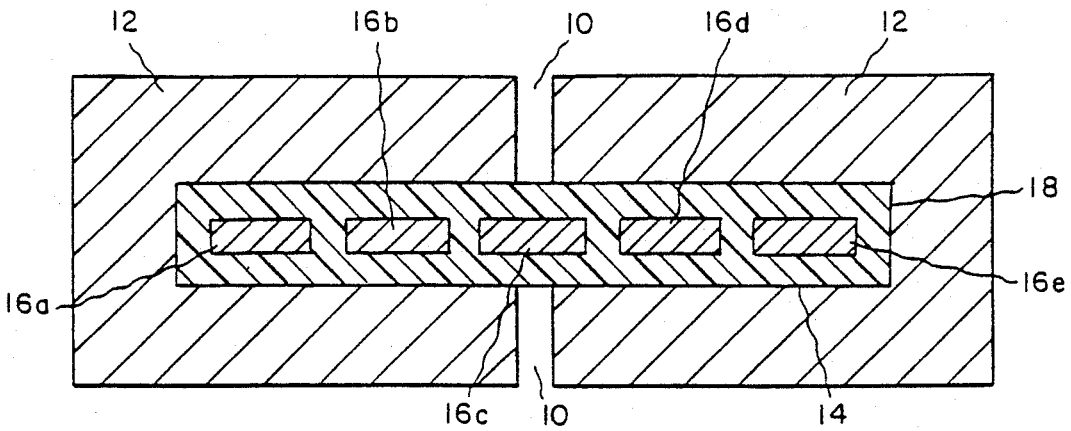
Fig. 1 (PRIOR ART)
FIG. 1 is a cross-sectional view of a lumped-gap sleeve inductor of the prior art.
Figure 3:
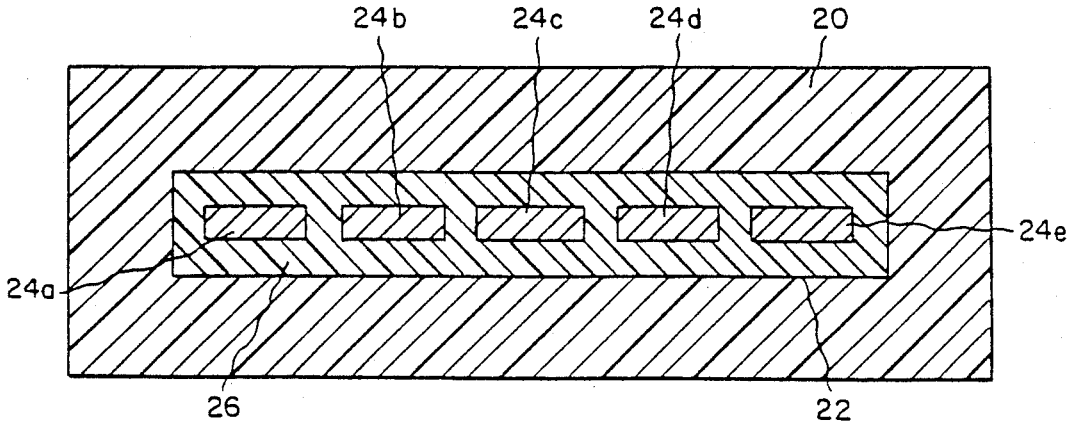
FIG. 3 is a cross-sectional view of a distributed-gap sleeve inductor.
Figure 4:
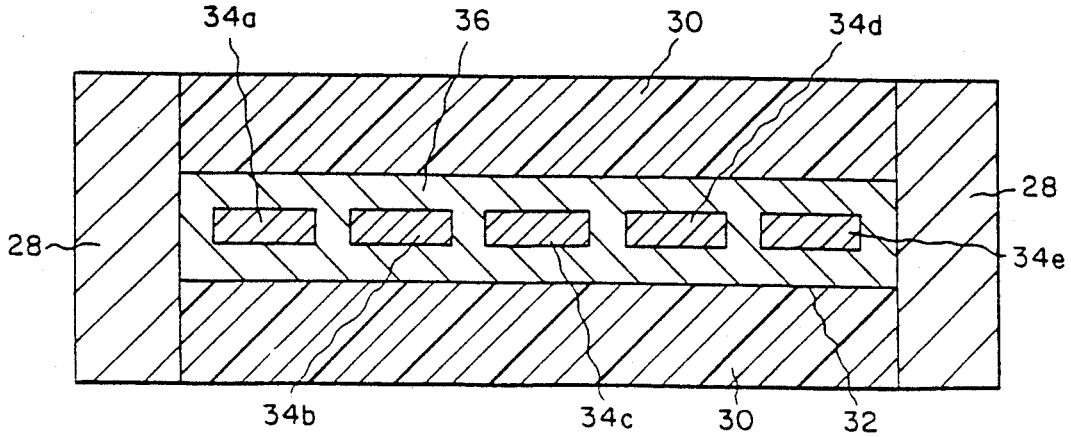
FIG. 4 is a cross-sectional view of a dual-permeability sleeve inductor constructed in accordance with the present invention.
Figure 2:
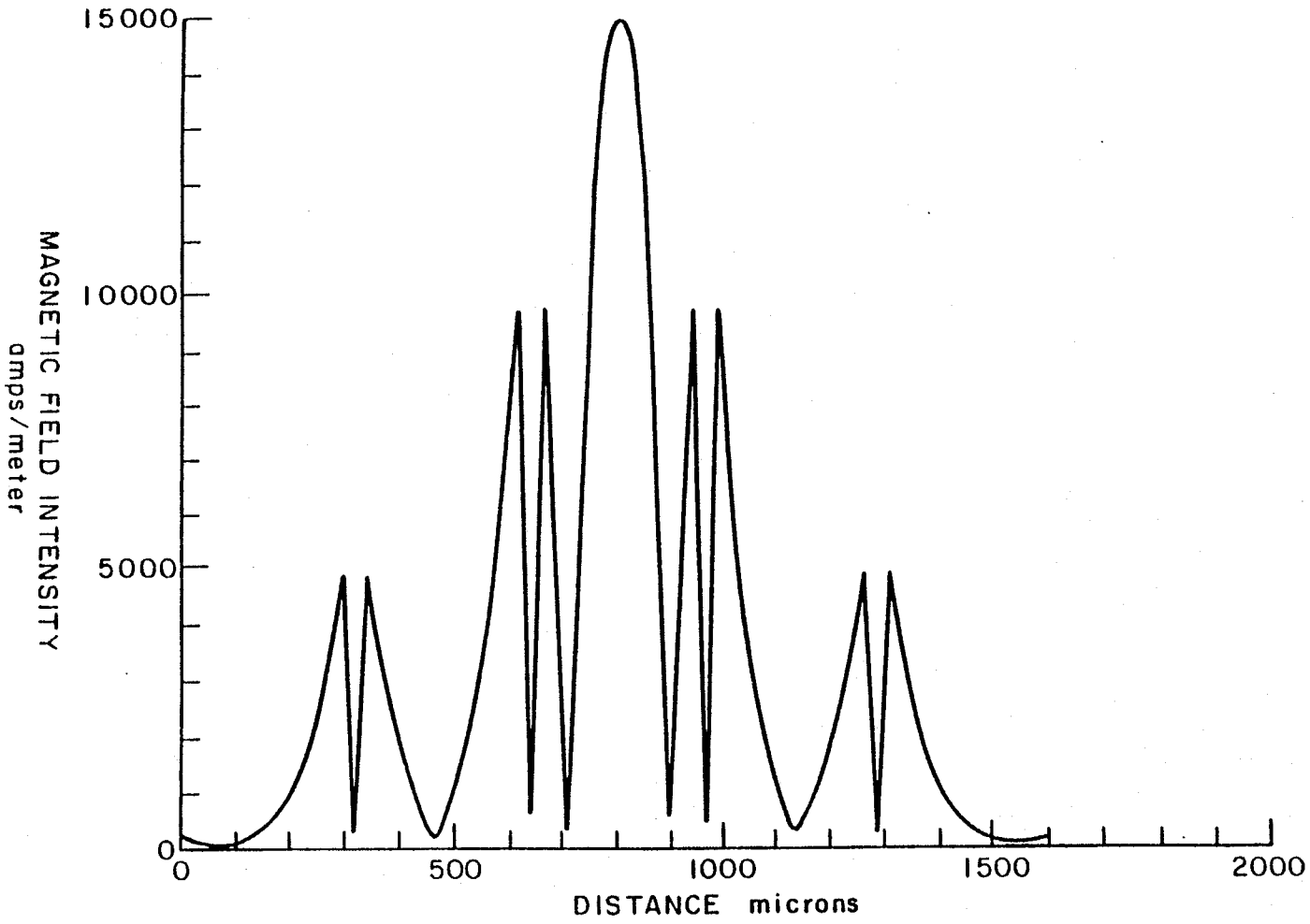
FIG. 2 is a graphical representation of the magnetic field intensity tangential to the surfaces of the five planar conductors of the inductor of FIG. 1 as a function of distance from either side of the core.

With reference to FIG. 4, a dual-permeability core structure according to the present invention is shown for a rectangular coordinate system. The new magnetic core structure does not have lumped air gaps 10 like the conventional core of FIG. 1, but is a closed-loop structure comprising a housing with distinct high-permeability sections 28 and low-permeability sections 30. The high-permeability magnetic sections are preferably comprised of a material having a permeability value that is at least ten times the value of the material comprising the low-permeability sections. The alternating high- and low-permeability sections surround a winding window 32 which contains planar conductors 34*a*, 34*b*, 34*c*, 34*d*, 34*e*. The new core is useful in magnetic components, such as inductors and transformers. It is to be understood that the size of the core and the number of planar conductors will vary, depending upon the type of, and application for, the magnetic component. Specifically, the embodiment of the present invention as shown in FIG. 4 is a sleeve inductor having a rectangular core, the high-permeability sections 28 comprising the sides and the low-permeability sections 30 comprising the top and the bottom thereof. Planar conductors are arranged in a common plane parallel to sections 30 to form a single-layer winding, and the conductors are encased by a thin insulating material 36 such as a solvent-evaporated or thermosetting plastic. In another version of the sleeve inductor (not shown), the planar conductors are arranged vertically in a stack to form a multi-layer winding.

Figure 5:
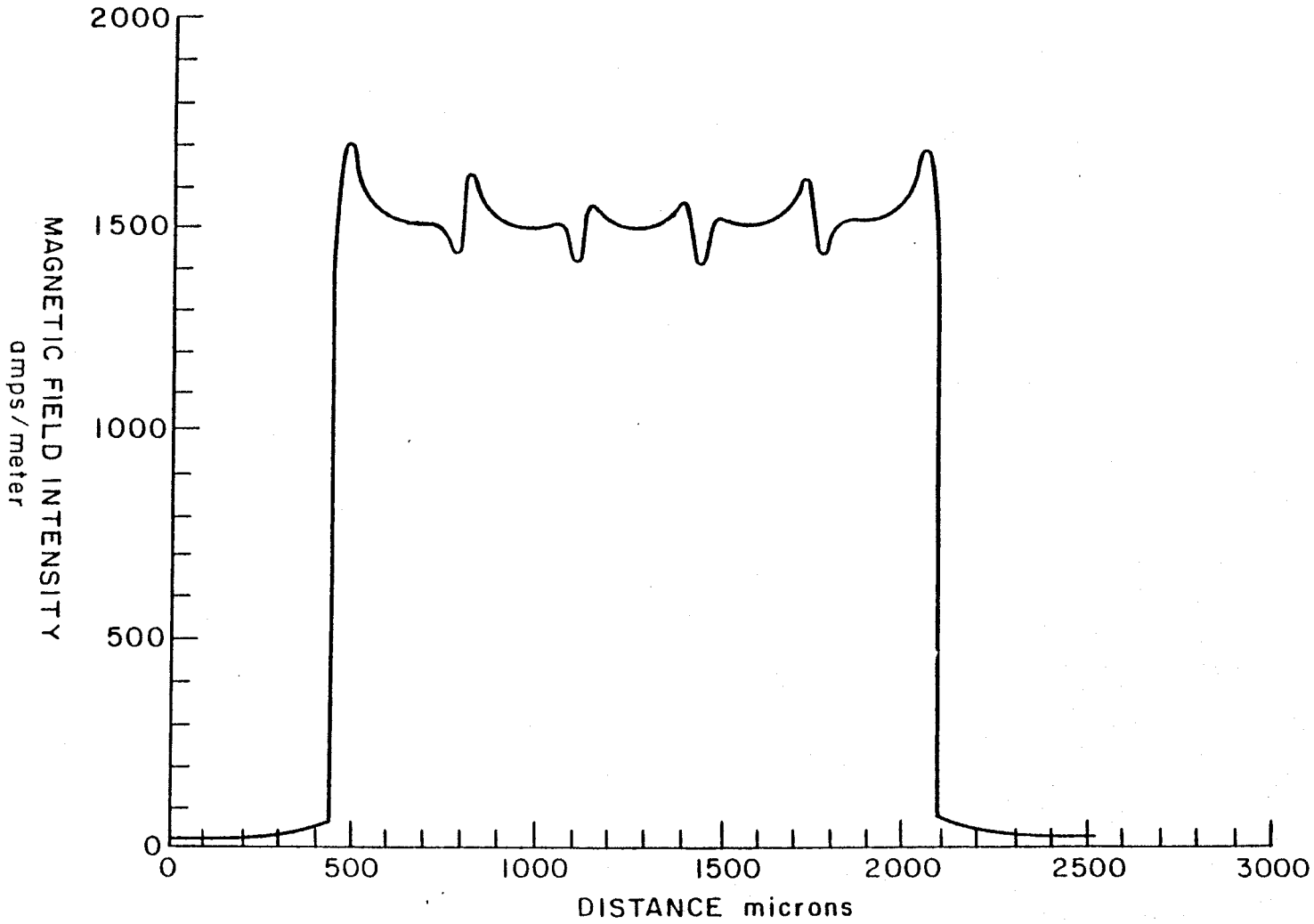
FIG. 5 is a graphical representation of the magnetic field intensity tangential to the surfaces of the five planar conductors of the inductor of FIG. 4.

According to the present invention, the arrangement of high- and low-permeability sections is such that the low-permeability sections carry flux flowing parallel to the planar conductor surfaces, and the high-permeability sections carry flux flowing perpendicular to the conductor surfaces. As a result, this rectangular structure exhibits a highly uniform magnetic field on the planar winding surfaces, as shown in the graph of FIG. 5. For this dual-permeability sleeve core configuration, the surface current density is also uniform. AC winding losses are thus reduced, and the AC-to-DC resistance ratio is close to unity.

Figure 6:
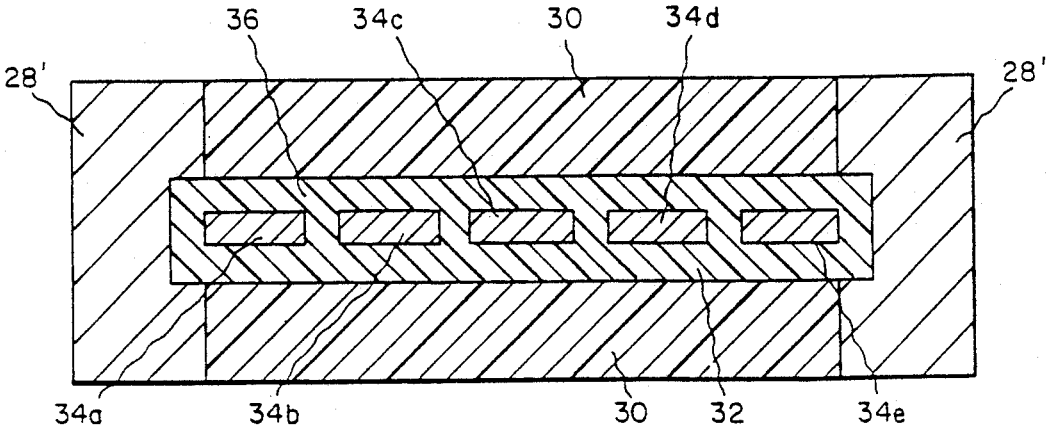
FIG. 6 is a cross-sectional view of another embodiment of the dual-permeability sleeve inductor of the present invention.

For a conductor which is long relative to its skin depth at the operating frequency of the magnetic component, i.e. 20 skin depths or more, there is an optimal sleeve core structure which minimizes AC winding losses. In this new structure, as shown in FIG. 6, the high-permeability sides 28' of the sleeve core are C-shaped in cross-section with their edges coinciding with imaginary lines drawn perpendicular to the top and bottom of the core through the outermost edges of the outermost conductors 34*a*, 34*e* in the winding window. For this configuration, the AC-to-DC resistance ratio is approximately 1.1.

Figure 7:
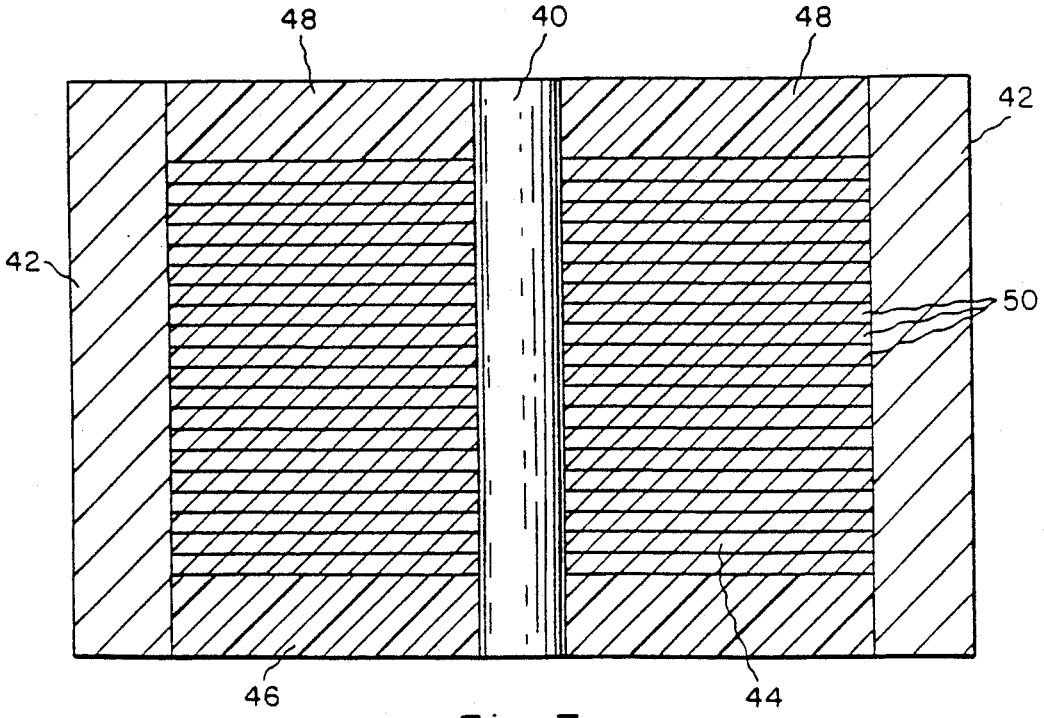
FIG. 7 is a cross-sectional view of a dual-permeability pot core structure enclosing a planar winding in accordance with the present invention.
Figure 8:
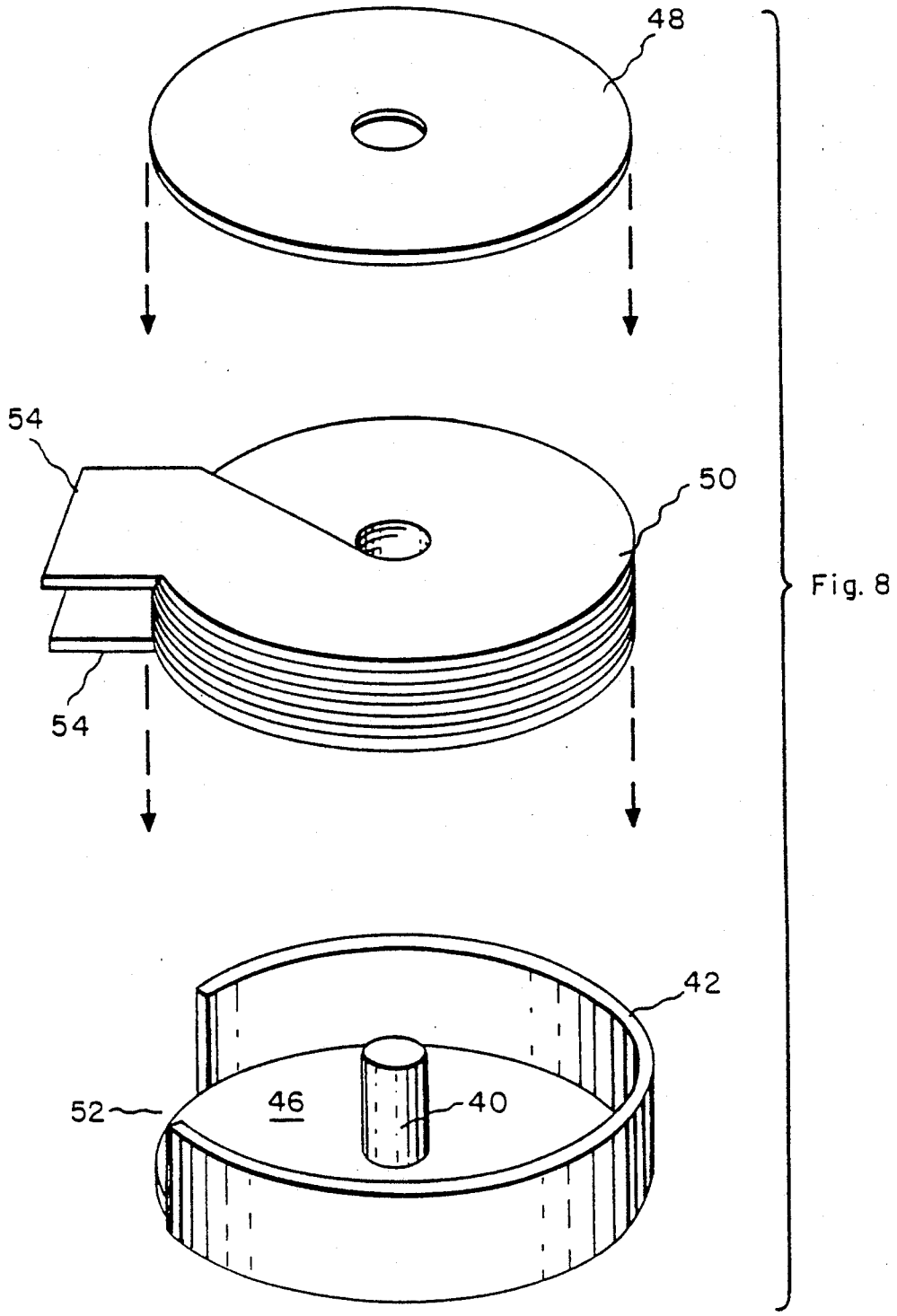
FIG. 8 is an exploded, perspective view of the pot core structure of FIG. 7.

The preferred embodiment of the present invention is a pot core structure as shown in cross-section in FIG. 7 and in an exploded view of the component parts in FIG. 8. The new pot core is cylindrical and has a core post 40 concentric with the cylindrical peripheral wall 42 of the core, the core post extending in a longitudinal direction between the opposite ends of the core. Both the cylindrical peripheral wall and the core post comprise the high-permeability permeability sections of the core. In the interior of the core, there is a cylindrical winding window 44 bounded by two low-permeability layers or sections 46,48 of the core and further by the high-permeability peripheral wall and core post. The winding window contains a plurality of circular, planar conductors 50 arranged in a stack along the longitudinal direction to form a single multi-layer winding. Or, in the case of a transformer, the stack of conductors 50 comprises interleaved multi-layer windings. In the dual-permeability pot core, the magnetic field intensity tangential to the surface of the windings varies inversely with the radius. The surface current density in the conductors also varies inversely with the radius, provided the radii are selected such that all the turns, whether a single turn per layer or multiple turns per layer, have the same resistance. As a result, the AC winding losses are minimized.

To fabricate a dual-permeability magnetic core according to the present invention, high-permeability and low-permeability magnetic materials must be prepared. A high-permeability ferrite exhibiting, of course, low losses at high frequencies is preferred. For example, a manganese-zinc ferrite according to the following composition is suitable: 4.2 mole percent nickel oxide; 14.27 mole percent zinc oxide; 20.57 mole percent manganese oxide; 51.6 mole percent iron oxide; with additions of calcium oxide and zirconium oxide of less than 1 mole percent.

The first step in pot core fabrication is to form a cylindrical cup-like core structure by machining the high-permeability ferrite to form a peripheral core wall 42 and a core post 40. A temporary or mounting base (not shown) is provided for positioning the wall and post. The temporary base may comprise any suitable rigid material. In addition, opening 52 in the peripheral wall of the pot core must be provided to accommodate winding leads 54 of the completed magnetic component.

The next step is to provide a first low-permeability magnetic layer 46 directly above and adjacent to the temporary base. According to the present invention, the low-permeability magnetic material comprising layer 46 preferably comprises a mixture of a ferrite powder and an organic binder. Alternatively, a sintered ferrite may be used. A suitable ferrite powder has an electrical resistivity greater than 500 ohm-centimeters, preferably greater than 0.2 megaohm-centimeters, at a temperature ranging from about 20° C. to about 100° C. These powders can be prepared by standard ceramic processing, generally by crushing a sintered ferrite or by calcining a particulate mixture of the constituent oxides which react by solid-state diffusion to form the desired ferrite.

In either case, the particles are screened according to the Standard Taylor Screen Series or are milled to produce the desired particle size distribution.

The ferrite powder is a magnetic oxide and is known in the art as a spinel ferrite. The present ferrite powder has a composition represented by the formula $MO(Fe_2O_3)_{1\pm x}$ where x has a value ranging from 0 to about 0.2, preferably ranging from 0 to about 0.1, and where M is the divalent metal cation selected from the group consisting of Mg, Mn, Fe, Co, Ni, Zn, Cu and combinations thereof. Representative of useful ferrites include nickel zinc ferrite and manganese zinc ferrite.

If desired, a minor amount of an inorganic oxide additive which promotes densification or has a particular effect on magnetic properties of spinel ferrites can be included in the starting powder. Such additives are well known in the art and include CaO, $SiO_2$, $B_2O_3$, $ZrO_2$ and $TiO_2$. As used herein, the term "ferrite powder" includes any such additive. The particular amount of additive is determinable empirically, and frequently it ranges from about 0.01 mole % to about 0.05 mole % of the total amount of ferrite powder..

If the ferrite powder is to be made from a crushed, sintered ferrite, then sintering is carried out in an oxygen-containing atmosphere, the composition of which depends largely on the composition of the powder desired. The temperature range for sintering is from about 1000° C. to about 1400°) C. Also, upon completion of the sintering, the sintered product may be cooled in the same atmosphere used for sintering, or in some other atmosphere. The sintering and cooling atmospheres should have no significant deleterious effect on the present ferrite. Generally, the sintering and cooling atmospheres are at about atmospheric or ambient pressure, and generally the sintered product is cooled to about room temperature, i.e. to about 20° C. to 30° C. The sintering and cooling atmospheres for the production of spinel ferrite bodies are well-known in the art.

For example, sintering may be carried out in an oxidizing oxygen-containing atmosphere. In such instance, oxygen generally is present in an amount greater than about 50% by volume of the atmosphere and the remaining atmosphere frequently is a gas such as nitrogen, a noble gas such as argon, or a combination thereof. Usually, the sintering atmosphere is comprised of air or oxygen. Also, in such instance, the sintered product generally is cooled in an oxidizing oxygen-containing atmosphere, usually the same atmosphere used for sintering, or some other atmosphere in which the sintered product is inert or substantially inert to produce the desired ferrite composition.

Generally, sintering of the ferrite can be controlled in a conventional manner, i.e. by shortening sintering time and/or lowering sintering temperature, to produce a sintered ferrite having a desired density or porosity or having a desired grain size. Sintering time may vary widely and generally ranges from about 5 minutes to about 5 hours. Usually, the longer the sintering time or the higher the sintering temperature, the more dense is the ferrite and the larger is the grain size.

The present sintered ferrite has a porosity ranging from about 0%, or about theoretical density, to about 40% by volume of the sintered ferrite. The particular porosity depends largely on the particular magnetic properties desired. Generally, the lower the porosity of the matrix, the higher is its magnetic permeability.

The ferrite powder is sinterable. Its particle size can vary. Generally, it has a specific surface area ranging from about 0.2 to about 10 meters$^2$ per gram, and frequently, ranging from about 2 to about 4 meters$^2$ per gram, according to BET surface area measurement.

The organic binder used in the present method bonds the particles together and enables formation of the low-permeability sections of the dual-permeability core. The organic binder is, preferably, an epoxy resin. Alternatively, it is a thermoplastic material with a composition which can vary widely or can be determined empirically. Besides an organic polymeric binder, it can include an organic plasticizer therefor to impart flexibility. The amount of plasticizer can vary widely depending largely on the particular binder used and the flexibility desired, but, typically, it ranges up to about 50% by weight of the total organic content.

Representatives of useful thermoplastic binders are polyvinyl acetates, polyamides, polyvinyl acrylates, polymethacrylates, polyvinyl alcohols, polyvinyl butyrals, and polystyrenes. The useful molecular weight of the binder is known in the art or can be determined empirically. Ordinarily, the organic binder has an average molecular weight at least sufficient to make it retain its shape at room temperature and generally such an average molecular weight ranges from about 20,000 to about 200,000, frequently from about 30,000 to about 100,000.

Representative of useful plasticizers are dioctyl phthalate, dibutyl phthalate, diisodecyl glutarate, polyethylene glycol and glycerol trioleate.

As stated above, the low-permeability material forming the low-permeability sections or layers of the dual-permeability core preferably comprises a mixture of a ferrite powder and an organic binder. Between the layers, a planar conductor winding 50 is inserted, and leads 54 of the windings are dammed, preferably with epoxy resin, to allow winding leads 54 to exit through opening 52 in the peripheral wall of the pot core. The mixture is formed either inside the cup-like core or outside the core according to the following alternative methods of the present invention. One method comprises simultaneous formation of the mixture and each layer by packing the ferrite powder into the core at a specified volume fraction, preferably about 50%, and then infiltrating the packed powder with an organic binder. A second alternate method entails preparing and casting a specified volume fraction mixture of the ferrite powder and the organic binder directly on the base and then allowing the mixture to solidify in place. Still a third alternative involves: preparing a mixture of the ferrite powder and an elastically deformable organic binder to form, for example, a ferrite tape; forming ring-shaped compacts from the mixture which conform to the internal dimensions of the core; and press fitting the compacts within the core in order to develop a close fit between the compacts and the core post and core wall. Yet a fourth method comprises: mixing the ferrite powder and the organic binder; forming a rigid composite block directly from the mixture or by sintering the mixture; machining the block to form two ring-shaped compacts which conform to the internal dimensions of the core; sliding fit the compacts to form the low-permeability layers within the core; and filling gaps between the low-permeability layers and the cup-like core with a second castable mixture of a fine ferrite powder and an organic binder.

The final step in pot core fabrication is the removal of the temporary base.

The following examples illustrate alternative methods for making a suitable ferrite powder in addition to methods for using the powders so formed to fabricate low-permeability magnetic material.

EXAMPLE 1

A sintered ferrite having a composition of approximately 31 mole % manganese oxide, 16 mole % zinc oxide, 53 mole % ferric oxide and less than 1 mole % additions of calcium oxide and zirconium oxide and having a relative initial permeability of approximately 1400 was crushed and screened. Individual screened fractions and a 50—50 weight % mixture of −12+14 mesh screened particles and −100 mesh particles (particle sizes herein are described by the nomenclature of the Standard Tyler Screen Series) were prepared for use. In the latter case, mixing of the two large and small particle size fractions allowed the preparation of epoxy bonded, low-permeability ring-shaped compacts having up to 75 volume % ferrite. Measurement of magnetic properties of the compacts gave values of relative initial permeabilities varying between 10 and 36. Specifically, the lower value corresponded to a ferrite packing fraction of about 50 volume % of −38+48 mesh fraction particles, and the upper value corresponded to a packing fraction of about 75 volume % of the large and small mixed fractions.

EXAMPLE 2

A sintered ferrite having a composition chemically analyzed to be approximately 4.22 mole % manganese oxide, 14.27 mole % zinc oxide, 29.57 mole % iron oxide, and approximately 0.3 mole % calcium oxide and having an initial relative permeability of about 610 was crushed and screened. Screen fractions from 200 mesh to 325 mesh were obtained and used to prepare epoxy bonded, low-permeability ring-shaped compacts having ferrite packing fractions ranging from about 50–60 volume % and initial permeability values between 6 and 10.

EXAMPLE 3

A powder mixture was prepared from finely sized, powdered chemicals, each of greater than 99% purity, according to the ferrite composition listed in Example 2. The mixture was calcined at 1050° C. in air for several hours to form a uniform ferrite phase in a finely divided state. A fraction of the powder mixture was then reheated to 1050° C., cooled to room temperature at a rate of −5° C. per minute in an atmosphere of nitrogen containing about 50 parts per million of oxygen, and broken up to pass through a 100 mesh screen. Ring-shaped compacts of this powder of ferrite volume fractions varying between 50 and 60 volume percent were measured for magnetic properties giving relative initial permeabilities between 6 and 8, with such permeabilities increasing with volume fraction ferrite.

EXAMPLE 4

A fraction of the calcined powder prepared in Example 3 was rolled on a tilted, slowly rotating plate for approximately 1 hour with approximately 0.1 weight % polyethylene glycol organic binder (commercially sold under the trademark Carbowax 3350 by Union Carbide Corporation) homogenously distributed on the ferrite powder particles by solvent evaporation. Relatively large, smoothly surfaced, spheroidal particles were thus formed ranging between 0.1 and 1 mm in diameter. Subsequently, the spheroidal particles were fired for approximately 2 hours at 1250° C. followed by cooling at −5° C. per minute in an atmosphere of nitrogen containing about 50 parts per million. The resultant sintered ferrite spheroids were measured to be about 90–95% dense, and simultaneous magnetic measurements of calibration ring-shaped compacts, sintered from the same calcined powder under the same firing conditions as above, gave relative initial permeability values of about 280.

EXAMPLE 5

A fraction of the calcined and nitrogen-oxygen cooled powder prepared by the method in Example 3 was tape cast with a polyvinylbutyral binder and toluene solvent in the form of sheets about 0.5 mm thick. The volume fractions of ferrite, binder and residual porosity in the final dried tape were about 0.6, 0.2 and 0.2, respectively. Magnetic measurements on copper wire-wound ring-shaped compacts, punched from the tape, gave an average value of 5.9 for the relative initial permeability of the tape material.

As illustrated in the above examples and in accordance with the present invention, the low-permeability sections of the dual-permeability cores generally are made from either highly porous, sintered magnetic materials or from composite materials which contain particulates of magnetic material. Examples 6–9 illustrate alternative methods of forming the low-permeability sections in the pot core of the preferred embodiment, including enclosure of the planar conductors within the winding window and completion of pot core fabrication.

EXAMPLE 6

A high-permeability ferrite having a permeability of approximately 1400 and a composition according to Example 1 was machined to form a cup-like core having a cylindrical peripheral wall, an interior core post concentric to the wall, and a temporary base upon which the wall and post were mounted. A ferrite powder of 50–50 weight % −12+14 mesh particles and −100 mesh particles, respectively, was prepared according to the method in Example 1. A fraction of the powder was packed to a depth of about 2 mm on the temporary base of the high-permeability cup-like core by means of a close fitting mandrel. The powder was then infiltrated with a low viscosity, catalyzed epoxy resin to form a first low-permeability layer which was then allowed to solidify in place. An inductor winding of 20 planar, insulated copper turns, each about 0.075 mm in thickness, was then inserted above the first low-permeability layer. After damming the winding lead openings in the core wall with epoxy, the winding was enclosed by a second low-permeability layer by packing the ferrite powder into the cup-like core to approximately the same volume fraction and thickness as the first powder layer. The winding window and the second ferrite powder layer were then infiltrated with epoxy. After solidification, the temporary base of high-permeability ferrite was removed by machining, thus exposing the first low-permeability layer. From the data in Example 1, the relative permeabilities of the first and second low-permeability layers were estimated to be about 10, whereas the relative permeabilities of the core post and core wall remained at the original value of about 1400.

EXAMPLE 7

A high-permeability ferrite having substantially the same composition and permeability value as that used in Example 2 was machined to form a cup-like core similar to the one used in Example 6. A ferrite powder was then prepared according to the method of Example 4. Using this powder and a packing fraction of about 50 volume % for the low-permeability sections, an inductor was fabricated according to the procedure described in Example 6.

EXAMPLE 8

A high-permeability ferrite having substantially the same composition and permeability value as that used in Example 2 was machined to form a cylindrical core post. This core post was mounted on a temporary base comprising a layer of wax paper on a glass plate. First and second ring-shaped compacts, each having an outside diameter of 1.5 cm and a thickness of 0.5 mm, were punched from the ferrite powder filled tape prepared according to the method of Example 5 such that the inside diameters of the compacts matched by press fit to the outside diameter of the high-permeability, cylindrical core post. The first compact, a 20 turn planar winding, a 5 mil diameter one-turn copper wire test winding, and a second compact were sequentially mounted on the core post. Two peripheral, 170 degree circular arc sections of high-permeability ferrite were then closely fixed to the outside circumference of the compacts by means of a catalyzed epoxy resin and a temporary holding and positioning jig, thus forming the cylindrical peripheral wall of the core. The temporary base was removed after epoxy solidification. For rigidity, the entire structure was then externally coated with a film of solvent-based plastic. Thus, the flux path circuit of this completed inductor was comprised of alternate sections of materials having permeability values of 5.9 and 600, respectively.

EXAMPLE 9

A ferrite powder of $-35+48$ mesh size was prepared according to the method of Example 1. An oversized composite block was prepared comprising the ferrite powder, approximately 45% by volume, and a catalyzed epoxy resin, approximately 55% by volume. First and second ring-shaped compacts, each 2 mm thick, were then machined from the composite block to dimensions providing a sliding fit to the core wall and core post of a high-permeability, 3 cm diameter cup-like core. The first compact was inserted into the cup-like core to form a first low-permeability layer and was then fixed to the core post and core wall by a second, gap filling composite of finely ground (average particle size of 3–5 microns) ferrite powder, prepared by milling the powder produced by the method in Example 3, and a catalyzed epoxy resin, 40–50% by volume. After insertion of a planar copper conductor winding, the second compact was inserted into the cup-like core on the exposed face of the winding and between the high-permeability post and wall, thus forming the second low-permeability layer. This second layer was then fixed in place by the same gap filling composite of fine powder and resin used for fixing the first low-permeability layer. The temporary high-permeability base was then removed by machining to give the completed inductor structure.

A procedure for fabricating a dual-permeability sleeve inductor according to the present invention is illustrated in the following example.

EXAMPLE 10

A sintered ferrite having a composition of approximately 50 mole % nickel oxide and 50 mole % ferric oxide, measured relative initial permeability of 12, porosity of about 10–12 volume % and bulk dc resistivity of greater than 1 megohm-cm was machined to form two rectangular plates having the dimensions 2.5 cm×2.0 cm×0.05 mm. A sandwich-like structure was formed by assembling the two plates with two copper strip conductors, each 0.125 mm by 3 mm in cross-section, between and abutting the two ferrite plates. The sandwich-like structure was then fixed with a catalyzed epoxy resin. Two bars of high-permeability ferrite, 2 mm×2 mm×2 cm, having a relative initial permeability of 1400, were attached vertically to the sides of the sandwich-like structure, thus forming the high-permeability sections of the core. The magnetic circuit was completed by filling gaps where the 2 cm edges of the low-permeability top and bottom plates met the high-permeability sides by means of a 50—50 mixture by volume of catalyzed epoxy resin and finely ground nickel ferrite powder.

While the preferred embodiments of the present invention have been shown and described herein, it will be obvious that such embodiments are provided by way of example only. Numerous variations, changes and substitutions will occur to those skilled in the art without departing from the invention herein. Accordingly, it is intended that the invention be limited only by the spirit and scope of the appended claims.

What is claimed is:

1. A method of manufacturing a high-frequency magnetic circuit component, for use as an inductor or a transformer,. having a closed-loop, dual-permeability magnetic pot core including therein a winding window which contains a plurality of planar conductors, comprising the steps of:

(a) machining a high-permeability ferrite to form a substantially cylindrical housing comprising an substantially cylindrical peripheral wall and a substantially cylindrical core post located in the interior of said cylindrical housing, said core post being concentric with said cylindrical wall;

(b) providing a temporary base for rigidly mounting said housing thereon;

(c) applying a first low-permeability layer above and adjacent to said temporary base;

(d) inserting at least one conductive winding into said housing, said winding lying above and adjacent to said first low-permeability layer;

(e) applying a second low-permeability layer above and adjacent to said winding; and (f) removing said temporary base.

2. The method of claim 1 wherein said first and second low-permeability layers each comprise a first mixture composed of a high-permeability ferrite powder and an organic binder.

3. The method of claim 1 wherein said low-permeability layers comprise a low-permeability, sintered ferrite powder.

4. The method of claim 1 wherein said low-permeability layers are rigid structures comprised of a sintered ferrite powder, said structures exhibiting porosity in excess of 20 volume %.

5. The method of claim 2 wherein said high-permeability ferrite powder comprises $MO(Fe_2O_3)_{1\pm x}$ where x has a value ranging from 0 to about 0.2 and where M is a divalent metal cation selected from the group consisting of Mg, Mn, Fe, Co, Ni, Zn, Cu and including combinations thereof.

6. The method of claim 2 wherein said high-permeability ferrite powder comprises a nickel zinc ferrite.

7. The method of claim 2 wherein said high-permeability ferrite powder comprises a manganese zinc ferrite.

8. The method of claim 2 wherein said ferrite powder comprises ferrite particles having a specific surface area in the range from about 0.2 to about 10 meters$^2$ per gram.

9. The method of claim 2 wherein said ferrite powder comprises substantially spheroidal ferrite particles.

10. The method of claim 2 wherein said organic binder comprises an epoxy resin.

11. The method of claim 2 wherein said organic binder comprises a thermoplastic material.

12. The method of claim 2 wherein said ferrite powder is prepared according to the steps of:

providing a high permeability ferrite-forming mixture;

calcining said high-permeability ferrite-forming mixture to form a substantially uniform, high-permeability ferrite; and comminuting said ferrite to produce a ferrite powder.

13. The method of claim 2 wherein the steps of applying a first low-permeability layer and applying a second low-permeability layer, respectively, each comprises:

packing said ferrite powder into said housing;

infiltrating said packed ferrite powder with said organic binder to form said first mixture; and permitting said first mixture to solidify.

14. The method of claim 2 wherein the steps of applying a first low-permeability layer and applying a second low-permeability layer, respectively, each comprises:

admixing said ferrite powder and said organic binder to form said first mixture;

allowing said first mixture to solidify;

machining a ring-shaped compact from said first mixture to conform to the shape of the interior of said housing:

inserting said compact into said housing; and infiltrating said housing with a second mixture comprising a ferrite powder and an organic binder to fill in any gaps between said compact and said housing.

15. The method of claim 2 wherein the steps of applying a first low-permeability layer and applying a second low-permeability layer, respectively, each comprises:

tape casting said ferrite powder with said organic binder to form a ferrite tape comprising said first mixture:

punching a ring-shaped compact from said tape;

inserting said ring-shaped compact into said housing; and infiltrating said housing with a second mixture comprising a ferrite powder and an organic binder to fill in any gaps between said compact and said housing.

16. The method of claim 2 wherein the steps of applying a first low-permeability layer and applying a second low-permeability layer, respectively, each comprises:

admixing said ferrite powder and said organic binder to form said first mixture;

17. The method of claim 2 wherein said first mixture comprises approximately 40–50% by volume of said ferrite powder and approximately 40–50% by volume of said organic binder.

18. A method of fabricating a high frequency magnetic circuit component, for use as an inductor or a transformer, having a closed-loop, dual-permeability sleeve core including a top, a bottom and two sides, said core including therein a winding window which contains a plurality of planar conductors, comprising the steps of:

(a) machining a low-permeability magnetic material to form two substantially rectangular plates;

(b) forming a sandwich-like structure by stacking said two plates and by mounting at least one conductive winding therebetween, said two plates comprising the top and the bottom of the core;

(c) fixing said sandwich-like structure by applying an organic binder thereto;

(d) machining a high-permeability magnetic material to form two substantially rectangular side members; and e) mounting said side members to said sandwich-like structure to form the sides of the core.

19. The method of claim 18 wherein said low-permeability magnetic material comprises a mixture of a ferrite powder and an organic binder and wherein said high-permeability magnetic material comprises a sintered ferrite.

20. The method of claim 18 wherein said low-permeability magnetic material and said high-permeability magnetic material each comprise a sintered ferrite.

* * * * *

UNITED STATES PATENT AND TRADEMARK OFFICE

CERTIFICATE OF CORRECTION

PATENT NO. : 5,062,197

DATED : November 5, 1991

INVENTOR(S) : RICHARD JOSEPH CHARLES

It is certified that error appears in the above-identified patent and that said Letters Patent is hereby corrected as shown below:

On the title page, item [54], and in column 1:

In the title, before "DUAL", add -- METHOD OF MAKING A -- .

Signed and Sealed this

Twenty-third Day of February, 1993

*Attest:*

STEPHEN G. KUNIN

*Attesting Officer*

*Acting Commissioner of Patents and Trademarks*